United States Patent [19]

Rosenberg

[11] 4,251,331

[45] Feb. 17, 1981

[54] BATHS AND ADDITIVES FOR THE ELECTROPLATING OF BRIGHT ZINC

[75] Inventor: William E. Rosenberg, Strongsville, Ohio

[73] Assignee: Columbia Chemical Corporation, Cleveland, Ohio

[21] Appl. No.: 113,120

[22] Filed: Jan. 17, 1980

[51] Int. Cl.[3] ..... C25D 3/22

[52] U.S. Cl. ..... 204/55 R; 204/DIG. 2

[58] Field of Search ..... 204/55 R, 55 Y, 114, 204/DIG. 2, 43 Z

[56] References Cited

U.S. PATENT DOCUMENTS

| | | | |
|---|---|---|---|
| 3,505,184 | 4/1970 | Schaedler et al. | 204/55 R |
| 3,729,394 | 4/1973 | Hsu et al. | 204/55 R |
| 4,070,256 | 1/1978 | Hsu et al. | 204/55 R |
| 4,137,133 | 1/1979 | Arcilesi | 204/55 R |

FOREIGN PATENT DOCUMENTS

| | | | |
|---|---|---|---|
| 1496869 | 10/1969 | Fed. Rep. of Germany | 204/55 R |

*Primary Examiner*—G. L. Kaplan

*Attorney, Agent, or Firm*—Oldham, Oldham, Hudak & Weber Co.

[57] ABSTRACT

A brightening agent is provided for the electrodeposition of zinc from an aqueous acid plating bath. The brightening agent is composed of an alpha-amino aliphatic carboxylic acid, a nonionic surface active compound and a carbonyl compound. The brightening agent may be added to an electroplating bath containing zinc ions, chloride ions, and boric acid. The use of the brightening agent eliminates the use of ammonium chloride as a bath constituent, and unexpectedly produces bright electrodeposits at extremely high current densities.

25 Claims, No Drawings

BATHS AND ADDITIVES FOR THE ELECTROPLATING OF BRIGHT ZINC

BACKGROUND OF THE INVENTION

The present invention relates to improvements in the electrodeposition of zinc from aqueous acid plating baths, not taught or suggested by the prior art, yielding the elimination of ammonia as a by-product discharged to waste treatment facilities, and yielding a synergistic result by producing bright deposits at high current densities. Non-ammoniated acidic zinc plating baths have been known, and these baths can be made to produce a bright electrodeposit of zinc. These baths, however, inherently produce bright electrodeposits over rather narrow current density ranges. The most predominant problem with these baths has been their inability to work well at the high current densities encountered at the edges of parts in situations where an excessive amount of current is required to obtain deposits in hard to plate recessed areas. Instead of being bright, the edges of the parts are plated with a dull, coarse deposit of zinc.

The use of ammonium chloride by those skilled in the art tends to alleviate these high current density problems, but new problems are created. The presence of ammonia is undesirable because of the biochemical oxygen demand caused by ammonia and the chlorine demand of the ammonia in waste treatment facilities. Additionally, certain complexing agents such as hydroxy carboxylic acids and ethylenediamine tetraacetic acid have been used to improve the quality of the high current density deposits. However, some of these complexing agents along with ammonia can make the precipitation of zinc during waste treatment very difficult, if not impossible.

The acid zinc bath formulations including ammonium ions as a bath constituent fail to address the ammonia effluent problem. U.S. Pat. No. 3,723,263, and a division thereof, U.S. Pat. No. 3,767,540, both relate to aqueous acid zinc electroplating baths containing naphthol polyoxyalkylate in combination with polyethyleneimine. These patents also state that aromatic aldehydes and ketones may be present. U.S. Pat. No. 3,729,394 relates to an acid zinc electroplating bath having dissolved therein a block copolymer of propylene oxide and ethylene oxide. The block copolymer may be utilized alone or in instances with a compound of N-(alkyl sulfonyl) glycine. Additionally, another U.S. patent, namely U.S. Pat. No. 2,674,619, relates to polyoxyalkylene compounds which have an outstanding detergent and surface agent properties and in which the hydrophobic element is a polyoxypropylene polymer having a molecular weight of at least 900.

Therefore, the need exists for a brightening agent which is capable of providing brightening effects over a broad range of electrodeposition current densities, while avoiding ammonia as a byproduct in such concentrations to excessively complicate waste treatment of the effluent from the plating bath.

SUMMARY OF THE INVENTION

Accordingly, it is an object of this invention to provide brightening agents which consistently produce bright electrodeposits of zinc over a wide current density range in an aqueous acid plating bath.

It is yet another object of the invention to provide brightening agents, as above, wherein the brightening agents allow the elimination of ammonium constituents which would otherwise produce byproducts which would create difficult waste treatment operations.

It is a still further object of the invention to provide brightening agents, as above, wherein said brightening agent is an alpha-aminoaliphatic carboxylic acid.

It is still another object of the invention to provide an aqueous acid zinc plating bath for zinc electrodeposition containing brightening agents as above.

These and other objects of the present invention which will become more apparent from the following specification, are accomplished by the compounds, formulations, and methods herein described and claimed.

In general, the objects of this invention are achieved by: a zinc brightening agent for addition to zinc electroplating baths, comprising: from about 1 to about 98 percent by weight of a zinc brightener selected from the group consisting of alpha-aminoaliphatic carboxylic acids, salts of alpha-aminoaliphatic carboxylic acids, and combinations thereof; said zinc brightener having the formula:

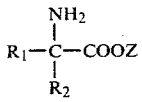

where $R_1$ and $R_2$ are hydrogen, alkyl, alicyclic, alkylaryl, or aryl groups, having from 1 to 12 carbon atoms and where Z is a bath compatible cation selected from the group consisting of hydrogen, sodium, potassium, zinc, calcium, and lithium; and from about 1 to 98 percent by weight of a nonionic surface active compound containing at least 6 moles of condensed ethylene oxide per mole of said nonionic surface active compound.

Further, the objects of the invention are achieved by: an aqueous, acid zinc electroplating bath for producing a bright electrodeposit of zinc, comprising: from about 15 to about 60 grams per liter of bath of zinc ions dissolved in the bath; from about 75 to about 175 grams per liter of bath of chloride ions dissolved in the bath; from about 0.5 to about 10 grams per liter of bath of a zinc brightener selected from the group consisting of alpha-aminoaliphatic carboxylic acids, salts of alpha-aminoaliphatic carboxylic acids, and combinations thereof; said zinc brightener having the formula:

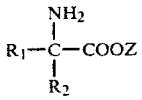

where $R_1$ and $R_2$ are hydrogen, alkyl, alicyclic, alkylaryl, or aryl groups, having from 1 to 12 carbon atoms and Z is a bath compatible cation selected from the group consisting of hydrogen, sodium, potassium, zinc, calcium, and lithium; and from about 0.5 to about 20 grams per liter of bath of a nonionic surface active compound containing at least 6 moles of condensed ethylene oxide per mole of said nonionic surface active compound.

DESCRIPTION OF THE PREFERRED EMBODIMENTS

According to the present invention, it has been found that the addition of a brightening agent composed of a zinc brightener selected from the group consisting of an alpha-aminoaliphatic carboxylic acid, a salt of an alpha-aminoaliphatic carboxylic acid, or combinations thereof, nonionic surface active compounds and carbonyl compounds to an aqueous acid zinc electroplating bath provide extremely bright electrodeposits over wide current densities.

The aqueous plating baths of this invention contain zinc ions and chloride ions and operate best at pH's from about 4.0 to about 6.3. The optimum pH is about 5.2. The source of zinc ions may be from a zinc salt, for example, zinc sulfate, zinc acetate, etc., with zinc chloride being preferred. A suitable concentration of zinc ions is from about 15 to about 60 grams per liter. The source of chloride ions may be from a salt soluble in the electroplating bath with the preferred salts being potassium chloride and sodium chloride. A suitable concentration of chloride ions is about 75 to about 175 grams per liter, with 135 grams per liter being the preferred amount.

The presence of about 7.5 to about 40 grams of boric acid per liter is beneficial in helping to obtain bright deposits in the high current density areas.

To the plating bath is added the brightening agent composed of an alpha-aminoaliphatic carboxylic acid, a nonionic surface active compound, and a carbonyl compound.

The alpha-aminoaliphatic carboxylic acids or their salts for the brightening agent have the following general formula:

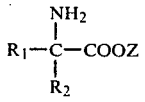

where $R_1$ and $R_2$ are reagent compatible end groups such as hydrogen, alkyl, alicyclic, alkylaryl, and aryl groups. The $R_1$ and $R_2$ groups may be branched or substituted and contain from 1 to 12 carbon atoms. Examples of some of the possible substituted groups are hydroxy, carboxy, amido, carboxyester and ether groups. The preferred $R_1$ and $R_2$ groups are hydrogen and alkyl groups containing from 1 to 6 carbon atoms. The Z group may be a bath compatible cation such as hydrogen, sodium, potassium, zinc, calcium, and lithium. Hydrogen is preferred. Table I lists some of these preferred compounds.

TABLE I

1. Aminoacetic acid
2. Alpha-aminopropionic acid
3. Alpha-aminobutyric acid
4. Alpha-aminoisobutyric acid
5. Alpha-aminovaleric acid
6. Alpha-aminohexanoic acid
7. Aminosuccinic acid
8. 1-amino-1-cyclopentane carboxylic acid Only aliphatic acids with the amine in the alpha position have been found to be effective in producing bright electrodeposits of zinc in the high current density areas. When the amino groups are in the beta and gamma positions, the compounds have no effect as brighteners. In addition to this, it has been discovered that the amine must be primary, since aliphatic carboxylic acids with secondary or tertiary amines in the alpha position also show no effectiveness as brighteners. The alpha-aminoaliphatic carboxylic acids are used at concentrations of from about 0.5 to about 10 grams per liter with the preferred amount being 3 to 6 grams per liter.

The alpha-aminoaliphatic carboxylic acids of this invention are used at approximately 1/100 the molar amount of ammonia used in the ammonium chloride baths, eliminating the concern of biochemical oxygen demand and chlorine demand in waste treatment. In addition to this, the compounds of this invention do not interfere with the precipitation of zinc at higher pH values.

The nonionic surface active compounds of this invention are readily available in commerce and are used at a concentration of from about 0.5 to about 20 grams per liter of bath. The preferred concentration is about 2 to about 10 grams per liter. The various types of nonionic surface active compounds that are part of this invention include, but are not limited to, (a) homopolymers of ethylene oxide; (b) propylene oxide-ethylene oxide block copolymers prepared by the sequential addition of propylene oxide and ethylene oxide in either order to a residue of any organic compound containing a plurality of hydrogen atoms and having a final molecular weight of 500; and the (c) ethylene oxide condensation products of naphthol and long chain fatty alcohols, long chain fatty amines, long chain fatty acids, long chain alkyl phenol. The long chain fatty groups contain from about 6 to about 30 carbon atoms.

The preferred amount of ethylene oxide used as a nonionic surface active compound is from about 6 to about 50 moles per mole of fatty compound or naphthol. The long chain groups may be branched, unsaturated, or substituted, or can even be substituted in multiple form such as with the polyhydroxy sorbitans.

The carbonyl compounds of this invention are aldehydes and ketones. Table II lists some specific preferred aldehydes and ketones of this invention. Concentrations of from about 0.01 to about 1 gram per liter may be used with the preferred amount being about 0.1 gram per liter.

TABLE II

1. Benzylidene acetone
2. Cinnamic aldehyde
3. o-chlorobenzaldehyde
4. 2,4-dichlorobenzaldehyde
5. 2,6-dichlorobenzaldehyde
6. 2-hydroxy-1-naphthaldehyde
7. Furfuryl acetone The brightening compounds of this invention can be added to the bath in concentrated form, but are more conveniently added by first dissolving them in a suitable solvent as a formulated addition agent. This addition agent may contain from about 1 to 98 percent by weight of the alpha-aminoaliphatic carboxylic acid or its salt and from about 1 to 98 percent by weight of a nonionic surface active compound. There can also be present from about 1 to about 20 percent by weight of an aldehyde or ketone. Suitable solvents are water and low molecular weight aliphatic alcohols and alcohol ethers such as methanol, ethanol, propanol, isopropanol, ethylene glycol, and ethylene glycol ethers.

Also present in either the addition agent or the plating bath may be at least one surface active compound selected from the group consisting of anionic surface active compounds, amphoteric surface active compounds, and cationic surface active compounds. These compounds are used to help solubolize the brighteners in the plating bath. These compounds may be present in a concentration of from about 1 to 50 percent by weight in the addition agent or from about 1 to about 20 grams per liter in the bath, and preferably from about 2 to 8 grams per liter of bath. Table III lists some of the preferred surface active agents.

TABLE III

| Commercial Surface | Manufacturer | Type | Chemical Description |
|---|---|---|---|
| Blancol N | GAF | Anionic | Sodium salt of a sulfonated naphthalene condensate |
| Aviral 100-E | Henkel, Inc. | Anionic | Sodium lauryl ether sulfate |
| Amine C | Ciba-Geigy | Cationic | Heterocyclic tertiary amine |
| Miranol CS | Miranol Chem. Co. | Amphoteric | Sulfonated imidazoline |
| Triton QS-15 | Rohm & Haas | Amphoteric | Ethoxylated sodium salt containing both anionic and cationic centers |

Also present in the addition agent may be from about 1 to 20 percent by weight of an auxiliary brightener such as an aromatic carboxylic acid or its salt. These aromatic acids add brightness to the lower current density areas and are used in the plating bath at a concentration of from about 1 to 5 grams per liter.

While the addition agents of the present invention are effective in many aqueous acid zinc plating bath formulations, the use of any of the basic baths described in the following examples have been found to give desirable results. Of course, it is to be understood that the following examples are merely illustrations and the invention is not limited thereto. The bath used in all the examples was made up as listed in Table IV. The tests were run in a 267 ml. Hull cell using mechanical agitation. Zinc anodes were used along with steel cathode panels. The panels were plated at 3 amperes for a period of 4 minutes at temperatures held between 75° F. and 85° F.

TABLE IV

| Bath Composition | Concentration in grams/liter |
|---|---|
| Zinc Chloride | 70 |
| Potassium Chloride | 207 |
| Boric Acid | 33 |
| pH = 5.2 | |

EXAMPLE I

| Compounds Added to Bath | Concentration in grams/liter |
|---|---|
| Nonylphenol-ethylene oxide condensation product (15 moles ethylene oxide) | 8 |
| Triton QS15 | 2 |
| Sodium Benzoate | 1.5 |
| o-Chlorobenzaldehyde | 0.075 |
| Aminoacetic acid | 3.75 |

EXAMPLE II

| Compounds Added to Bath | Concentration in grams/liter |
|---|---|
| Nonylphenol-ethylene oxide | 8 |

-continued

| Compounds Added to Bath | Concentration in grams/liter |
|---|---|
| Condensate (15 moles ethylene oxide) | |
| Triton QS-15 | 2 |
| Sodium Benzoate | 1.5 |
| o-Chlorobenzaldehyde | 0.075 |
| DL-aminosuccinic acid | 3 |

EXAMPLE III

| Compounds Added to Bath | Concentration in grams/liter |
|---|---|
| Nonylphenol-ethylene oxide | 8 |
| Condensate (15 moles ethylene oxide) | |
| Triton QS-15 | 2 |
| Sodium Benzoate | 1.5 |
| o-Chlorobenzaldehyde | 0.075 |
| 1-amino-1-cyclopentane carboxyl acid | 3 |

EXAMPLE IV

| Compounds Added to Bath | Concentration in grams/liter |
|---|---|
| Propylene oxide-ethylene oxide block copolymer prepared by the sequential addition of propylene oxide followed by ethylene oxide in an ethylene diamine base to a total molecular weight of 3,000 with the polyoxyethylene portion being 40 percent by weight | 2 |
| Avirol 100-E | 4 |
| Tetramethyl decyne diol ethylene oxide condensate (30 moles ethylene oxide) | 4 |
| Sodium Benzoate | 1.5 |
| 2,4-dichlorobenzaldehyde | 0.1 |
| DL-alpha-aminopropionic acid | 6 |

EXAMPLE V

| Compounds Added to Bath | Concentration in g/l (Tests #1 and #2) |
|---|---|
| Beta naphthol-ethylene oxide condensate (12 moles ethylene oxide) | 2 |
| Sorbitan monolaurate ethylene oxide condensate (20 moles ethylene oxide) | 2 |
| Sodium Benzoate | 1.5 |
| 2-hydroxy-1-naphthaldehyde | 0.075 |
| Alpha-aminoisobutyric acid | 6 |

EXAMPLE VI

| Compounds Added to Bath | Concentration in g/l |
|---|---|
| Beta naphthol-ethylene oxide condensate (12 moles ethylene oxide) | 2 |
| Sorbitan monolaurate-ethylene oxide condensate (20 moles ethylene oxide) | 2 |
| Triton QS-15 | 2 |
| Sodium Benzoate | 1.5 |
| Benzylidene acetone | 0.075 |

-continued

| Compounds Added to Bath | Concentration in g/l |
|---|---|
| DL-alpha-aminobutyric acid | 3.75 |

The results of the plating tests for Examples I through VI are described in Table V. Comparison tests for the above formulations were conducted with and without the alpha-aminocarboxylic acids. In all cases, the bright plating range was increased by the addition of an alpha-aminoaliphatic carboxylic acid.

TABLE V

Results of Plating Tests

| Bath Composition | Test Results |
|---|---|
| 1(a) Example I without amino-acetic acid | Bright deposit from 0 to about 110 amps per sq. ft. Dull, coarse deposit from 110 amps per sq. ft. and over. |
| (b) Example I with amino-acetic acid | Bright deposit from over 180 amps per sq. ft. |
| 2(a) [see 1(a)] | |
| (b) Example II with DL aminosuccinic acid | Bright deposit from 0 to over 180 amps per sq. ft. |
| 3(a) [see 1(a)] | |
| (b) Example III | Bright deposit from 0 to over 180 amps per sq. ft. |
| 4(a) Example IV without DL-alpha-aminopropionic acid | Bright deposit from 0 to about 80 amps per sq. ft. Dull, coarse deposit above 80 amps per sq. ft. |
| (b) Example IV with DL-alpha-aminoisobutyric acid | Bright deposit from 0 to over 180 amps per sq. ft. |
| 5(a) Example V without alpha-aminoisobutyric acid | Bright from 0 to about 120 amps per sq. ft. Dull, coarse deposit at 120 amps per sq. ft. and above. |
| (b) Example V with alpha-aminoisobutyric acid | Bright deposit from 0 to about 180 amps per sq. ft. |
| 6(a) Example VI without DL-alpha-aminobutyric acid | Bright deposit from 0 to about 100 amps per sq. ft. Dull, coarse deposit about 100 amps per sq. ft. |
| (b) Example VI with DL-alpha-aminobutyric acid | Bright deposit from 0 to about 150 amps per sq. ft. |

Having thus described the invention in such full, clear, concise, and exact terms as to enable any person skilled in the art to which it pertains to make and use the same and having set forth the best mode contemplated of carrying out this invention in accordance with patent statutes, it will be apparent to those skilled in the art that equivalents or modifications of the above specifically described embodiment of the invention may be made without departing from the spirit of the invention disclosed and described, the scope of the invention being limited solely by the scope of the attached claims.

What is claimed is:

1. A zinc brightening agent for addition to zinc electroplating baths, comprising:

from about 1 to about 98 percent by weight of a zinc brightener selected from the group consisting of alpha-aminoaliphatic carboxylic acids, salts of alpha-aminoaliphatic carboxylic acids, and combinations thereof;

said zinc brightener having the formula:

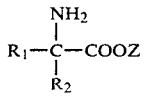

where $R_1$ and $R_2$ are hydrogen, alkyl, alicyclic, alkyl aryl, or aryl groups, having from 1 to 12 carbon atoms and where Z is a bath compatible cation selected from the group consisting of hydrogen, sodium, potassium, zinc, calcium, and lithium; and from about 1 to 98 percent by weight of a nonionic surface active compound containing at least 6 moles of condensed ethylene oxide per mole of said nonionic surface active compound.

2. A zinc brightening agent according to claim 1, wherein said nonionic surface active compound is at least one compound selected from the group consisting of (a) homopolymers of ethylene oxide; (b) propylene oxide-ethylene oxide block copolymers of a molecular weight of 500 or more, prepared by the sequential addition of propylene oxide and ethylene oxide in either order to a residue of any organic compound containing a plurality of active hydrogen atoms; and (c) the products obtained upon condensing from 6 to about 50 moles of ethylene oxide with a mole of a reactant selected from the group consisting of naphthol, and a long chain compound, said long chain compound having from about 6 to about 30 carbon atoms and selected from the group consisting of a long chain fatty acid, a long chain fatty alcohol, a long chain fatty amine, and a long chain alkyl phenol.

3. A zinc brightening agent according to claim 2, further comprising from about 1 to about 20 percent by weight of a carbonyl compound.

4. A zinc brightener additive according to claim 3 wherein said carbonyl compound is at least one compound selected from the group consisting of benzylidene acetone, cinnamic aldehyde, o-chlorobenzaldehyde, 2,4-dichlorobenzaldehyde, 2,6-dichlorobenzaldehyde, 2-hydroxyl-1-naphthaldehyde, and furfuryl acetone.

5. A zinc brightening agent according to claim 4, further comprising from about 1 to about 50 percent by weight of at least one surface active compound selected from the group consisting of anionic surface active compounds, amphoteric surface active compounds, and cationic surface active compounds.

6. A zinc brightening agent according to claim 4 further comprising from about 1 to about 20 percent by weight of an auxiliary brightener selected from the group consisting of an aromatic carboxylic acid, the salt of an aromatic carboxylic acid, and combinations thereof.

7. A zinc brightening agent according to claim 4 wherein $R_1$ is hydrogen and $R_2$ is a reagent compatible end group selected from the group consisting of hydrogen and an alkyl group containing from 1 to 6 carbon atoms.

8. A zinc brightening agent according to claim 4, wherein said $R_1$ and $R_2$ are hydrogen.

9. A zinc brightening agent according to claim 4, wherein said $R_1$ is hydrogen and $R_2$ is methyl.

10. A zinc brightening agent according to claim 4, wherein said $R_1$ is hydrogen and $R_2$ is ethyl.

11. A zinc brightening agent according to claim 4, wherein said $R_1$ is hydrogen and $R_2$ is propyl.

12. A zinc brightening agent according to claim 1, further comprising from about 1 to about 20 percent by weight of a carbonyl compound.

13. An aqueous, acid zinc electroplating bath for producing a bright electrodeposit of zinc, comprising:

from about 15 to about 60 grams per liter of bath of zinc ions dissolved in the bath;

from about 75 to about 175 grams per liter of bath of chloride ions dissolved in the bath;

from about 0.5 to about 10 grams per liter of bath of a zinc brightener selected from the group consisting of alpha-aminoaliphatic carboxylic acids, salts of alpha-aminoaliphatic carboxylic acids, and combinations thereof;

said zinc brightener having the formula:

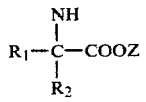

where $R_1$ and $R_2$ are hydrogen, alkyl, alicyclic, alkylaryl, or aryl groups having from 1 to 12 carbon atoms and where Z is a bath compatible cation selected from the group consisting of hydrogen, sodium, potassium, zinc, calcium, and lithium; and from about 0.5 to about 20 grams per liter of bath of a nonionic surface active compound containing at least 6 moles of condensed ethylene oxide per mole of said nonionic surface active compound.

14. A bath according to claim 13, wherein the nonionic surface active compound is at least one compound selected from the group consisting of (a) homopolymers of ethylene oxide; (b) propylene oxide-ethylene oxide block copolymers of a molecular weight of 500 or more, prepared by the sequential addition of propylene oxide and ethylene oxide in either order to a residue of any organic compound containing a plurality of active hydrogen atoms; (c) the products obtained upon condensing from 6 to about 50 moles of ethylene oxide with a mole of a reactant selected from the group consisting of naphthol and a long chain compound, said long chain compound selected from the group consisting of a long chain fatty acid, a long chain fatty alcohol, a long chain fatty amine, and a long chain alkyl phenol, wherein said long chain compound contains from 6 to about 30 carbon atoms.

15. A bath according to claim 14, including from about 0.01 to 1 gram per liter of a carbonyl compound.

16. A bath according to claim 15, wherein said carbonyl compound is at least one compound selected from the group consisting of benzylidene acetone, cinnamic aldehyde, o-chlorobenzaldehyde, 2,4-dichlorobenzaldehyde, 2,6-dichlorobenzaldehyde, 2-hydroxy-1-naphthaldehyde, and furfuryl acetone.

17. A bath according to claim 16, further comprising from about 1 to about 20 grams per liter of at least one surface active compound selected from the group consisting of anionic surface active compounds, amphoteric surface active compounds, and cationic surface active compounds.

18. A bath according to claim 16, further comprising from about 1 to about 5 grams per liter of an auxiliary brightener selected from the group consisting of an aromatic carboxylic acid, the salt of an aromatic carboxylic acid, and combinations thereof.

19. A bath according to claim 16, 17, or 18 further comprising from about 7.5 to about 40 grams per liter of boric acid.

20. A bath according to claim 18, wherein said auxiliary brightener is benzoic acid.

21. A bath according to claim 16, wherein $R_1$ is hydrogen and $R_2$ is selected from the group consisting of hydrogen and an alkyl group containing from 1 to 6 carbon atoms.

22. A bath according to claim 16, wherein said $R_1$ and said $R_2$ are hydrogen.

23. A bath according to claim 16, wherein said $R_1$ is hydrogen and $R_2$ is methyl.

24. A bath according to claim 16, wherein said $R_1$ is hydrogen and $R_2$ is ethyl.

25. A bath according to claim 16, wherein said $R_1$ is hydrogen and $R_2$ is propyl.

* * * * *

UNITED STATES PATENT AND TRADEMARK OFFICE

CERTIFICATE OF CORRECTION

PATENT NO. : 4,251,331

DATED : February 17, 1981

INVENTOR(S) : William E. Rosenberg

It is certified that error appears in the above-identified patent and that said Letters Patent is hereby corrected as shown below:

Column 9, line 21, in the formula, change "NH" to --$NH_2$-- .

Signed and Sealed this

Nineteenth Day of July, 1994

Bruce Lehman

*Attest:*

BRUCE LEHMAN

*Attesting Officer*

*Commissioner of Patents and Trademarks*

US004251331B1

REEXAMINATION CERTIFICATE (1923rd)

United States Patent [19]

Rosenberg

[11] B1 4,251,331

[45] Certificate Issued Feb. 9, 1993

[54] BATHS AND ADDITIVES FOR THE ELECTROPLATING OF BRIGHT ZINC

[75] Inventor: William E. Rosenberg, Strongsville, Ohio

[73] Assignee: Columbia Chemical Corporation, Cleveland, Ohio

Reexamination Request:
No. 90/002,518, Nov. 25, 1991

Reexamination Certificate for:

| | |
|---|---|
| Patent No.: | **4,251,331** |
| Issued: | **Feb. 17, 1981** |
| Appl. No.: | **113,120** |
| Filed: | **Jan. 17, 1980** |

[51] Int. Cl.[5] ..... C25D 3/22
[52] U.S. Cl. ..... 205/314; 205/312; 205/313
[58] Field of Search ..... 205/305, 308, 311, 314, 205/312, 313

[56] References Cited

U.S. PATENT DOCUMENTS 3,833,486 9/1974 Nobel et al. ..... 204/44
4,070,256 1/1978 Hsu et al. ..... 204/55 R
4,075,066 2/1978 Eckles et al. ..... 204/55 R
4,270,990 6/1981 Fong ..... 204/55 R

FOREIGN PATENT DOCUMENTS 30319 1/1973 Australia .

OTHER PUBLICATIONS

Morrison and Boyd, "Organic Chemistry" Second Edition Allyn and Bacon, Inc., p. 1099, Aug. 1966.
E. L. Smith, et al. "Principles of Biochemistry: General Aspects" Seventh Edition, McGray-Hill Book Co., pp. 32-33, 1983.

*Primary Examiner*—John F. Niebling

[57] ABSTRACT

A brightening agent is provided for the electrodeposition of zinc from an aqueous acid plating bath. The brightening agent is composed of an alpha-amino aliphatic carboxylic acid, a nonionic surface active compound and a carbonyl compound. The brightening agent may be added to an electroplating bath containing zinc ions, chloride ions, and boric acid. The use of the brightening agent eliminates the use of ammonium chloride as a bath constituent, and unexpectedly produces bright electrodeposits at extremely high current densities.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION IT HAS BEEN DETERMINED THAT:

Claims 1–3 and 12–15 are cancelled.

Claims 4 and 16 are determined to be patentable as amended.

Claims 5–11 and 17–25, dependent on an amended claim, are determined to be patentable.

New claims 26–73 are added and determined to be patentable.

4. A zinc [brightener additive according to claim 3 wherein] *brightening agent for addition to zinc electroplating baths, comprising:*

*from about 1 to about 98 percent by weight of a zinc brightener selected from the group consisting of alpha-aminoaliphatic carboxylic acids, salts of alpha-aminoaliphatic carboxylic acids, and combinations thereof;*

*said zinc brightener having the formula:*

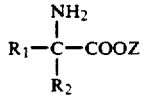

*where $R_1$ and $R_2$ are hydrogen, alkyl, alicyclic, alkyl aryl, or aryl groups, having from 1 to 12 carbon atoms and where Z is a bath compatible cation selected from the group consisting of hydrogen, sodium, potassium, zinc, calcium, and lithium; and*

*from about 1 to 98 percent by weight of a nonionic surface active compound containing at least 6 moles of condensed ethylene oxide per mole of said nonionic surface active compound, said nonionic surface active compound being at least one compound selected from the group consisting of (a) homopolymers of ethylene oxide; (b) propylene oxide-ethylene oxide block copolymers of a molecular weight of 500 or more, prepared by the sequential addition of propylene oxide and ethylene oxide in either order to a residue of any organic compound containing a plurality of active hydrogen atoms; (c) the products obtained upon condensing from 6 to about 50 moles of ethylene oxide with a mole of a reactant selected from the group consisting of naphthol, and a long chain compound, said long chain compound having from about 6 to about 30 carbon atoms and selected from the group consisting of a long chain fatty acid, a long chain fatty alcohol, a long chain fatty amine, and a long chain alkyl phenol, and*

*from about 1 to about 20 percent by weight of a carbonyl compound,* said carbonyl compound [is] *being* at least one compound selected from the group consisting of benzylidene acetone, cinnamic aldehyde, o-chlorobenzaldehyde, 2,4-dichlorobenzaldehyde, 2,6-dichlorobenzaldehyde, 2-hydroxyl-1-naphthaldehyde, and furfuryl acetone.

16. [A bath according to claim 15, wherein] *An aqueous, acid zinc electroplating bath for producing a bright electrodeposit of zinc, comprising:*

*from about 15 to about 60 grams per liter of bath of zinc ions dissolved in the bath;*

*from about 75 to about 175 grams per liter of bath of chloride ions dissolved in the bath;*

*from about 0.5 to about 10 grams per liter of bath of a zinc brightener selected from the group consisting of alpha-aminoaliphatic carboxylic acids, salts of alpha-aminoaliphatic carboxylic acids, and combinations thereof;*

*said zinc brightener having the formula:*

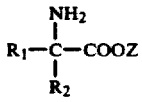

*where $R_1$ and $R_2$ are hydrogen, alkyl, alicyclic, alkylaryl, or aryl groups having from 1 to 12 carbon atoms and where Z is a bath compatible cation selected from the group consisting of hydrogen, sodium, potassium, zinc, calcium, and lithium; and*

*from about 0.5 to about 20 grams per liter of bath of a nonionic surface active compound containing at least 6 moles of condensed ethylene oxide per mole of said nonionic surface active compound, said nonionic surface active compound being at least one compound selected from the group consisting of (a) homopolymers of ethylene oxide; (b) propylene oxide-ethylene oxide block copolymers of a molecular weight of 500 or more, prepared by the sequential addition of propylene oxide and ethylene oxide in either order to a residue of any organic compound containing a plurality of active hydrogen atoms; (c) the products obtained upon condensing from 6 to about 50 moles of ethylene oxide with a mole of a reactant selected from the group consisting of naphthol, and a long chain compound, said long chain compound selected from the group consisting of a long chain fatty acid, a long chain fatty alcohol, a long chain fatty amine, and a long chain alkyl phenol, wherein said long chain compound contains from 6 to about 30 carbon atoms; and*

*from about 0.01 to 1 gram per liter of a carbonyl compound,* said carbonyl compound [is] *being* at least one compound selected from the group consisting of benzylidene acetone, cinnamic aldehyde, o-chlorobenzaldehyde, 2,4-dichlorobenzaldehyde, 2,6-dichlorobenzaldehyde, 2-hydroxy-1-naphthaldehyde, and furfuryl acetone.

*26. A zinc brightening agent according to claim 4, wherein said brightener is for an acid chloride zinc electroplating bath.*

*27. A zinc brightening agent according to claim 26, wherein said zinc brightener is an alpha-aminoaliphatic carboxylic acid.*

*28. A zinc brightening agent according to claim 26, wherein said zinc brightener is a salt of an alpha-aminoaliphatic carboxylic acid.*

*29. A zinc brightening agent according to claim 26, wherein said zinc brightener is an alpha-aminoaliphatic* carboxylic acid and a salt of an alpha-aminoaliphatic carboxylic acid.

30. A zinc brightening agent according to claim 26, wherein said cation is hydrogen.

31. A zinc brightening agent according to claim 26, wherein said cation is sodium.

32. A zinc brightening agent according to claim 26, wherein said cation is potassium.

33. A zinc brightening agent according to claim 26, wherein said cation is zinc.

34. A zinc brightening agent according to claim 26, wherein said cation is calcium.

35. A zinc brightening agent according to claim 26, wherein said nonionic surface-active compound is a homopolymer of ethylene oxide.

36. A zinc brightening agent according to claim 26, wherein said nonionic surface-active compound is a propylene oxide-ethylene oxide block copolymer of a molecular weight of 500 or more, prepared by the sequential addition of propylene oxide and ethylene oxide in either order to a residue of any organic compound containing a plurality of active hydrogen atoms.

37. A zinc brightening agent according to claim 26, wherein said nonionic surface-active compound is the product obtained upon condensing from 6 to about 50 moles of ethylene oxide with a mole of naphthol.

38. A zinc brightening agent according to claim 26, wherein said nonionic surface-active compound is the product obtained upon condensing from 6 to about 50 moles of ethylene oxide with a mole of a long chain compound having from about 6 to about 30 carbon atoms and selected from the group consisting of a long chain fatty acid, a long chain fatty alcohol, a long chain fatty amine, and a long chain alkyl phenol.

39. A zinc brightening agent according to claim 26, wherein said carbonyl compound is benzylidene acetone.

40. A zinc brightening agent according to claim 26, wherein said carbonyl compound is cinnamic aldehyde.

41. A zinc brightening agent according to claim 26, wherein said carbonyl compound is o-chlorobenzaldehyde.

42. A zinc brightening agent according to claim 26, wherein said carbonyl compound is 2,4-dichlorobenzaldehyde.

43. A zinc brightening agent according to claim 26, wherein said carbonyl compound is 2,6-dichlorobenzaldehyde.

44. A zinc brightening agent according to claim 26, wherein said carbonyl compound is 2-hydroxyl-1-naphthaldehyde.

45. A zinc brightening agent according to claim 5, wherein said brightener is for an acid chloride zinc electroplating bath.

46. A zinc brightening agent according to claim 6, wherein said brightener is for an acid chloride zinc electroplating bath.

47. A zinc brightening agent according to claim 7, wherein said brightener is for an acid chloride zinc electroplating bath.

48. A zinc brightening agent according to claim 8, wherein said brightener is for an acid chloride zinc electroplating bath.

49. A zinc brightening agent according to claim 48, wherein said cation is hydrogen, wherein said carbonyl compound is o-chlorobenzaldehyde, and wherein said nonionic surface-active compound is the product obtained upon condensing from 6 to about 50 moles of ethylene oxide with a mole of naphthol.

50. A zinc brightening agent according to claim 48, wherein said cation is hydrogen, wherein said carbonyl compound is o-chlorobenzaldehyde, and wherein said nonionic surface-active compound is the product obtained upon condensing from 6 to about 50 moles of ethylene oxide with a mole of a long chain compound having from about 6 to about 30 carbon atoms and selected from the group consisting of a long chain fatty acid, a long chain fatty alcohol, a long chain fatty amine, and a long chain alkyl phenol.

51. A zinc brightening agent according to claim 9, wherein said brightener is for an acid chloride zinc electroplating bath.

52. A zinc brightening agent according to claim 10, wherein said brightener is for an acid chloride zinc electroplating bath.

53. A zinc brightening agent according to claim 11, wherein said brightener is for an acid chloride zinc electroplating bath.

54. A bath according to claim 16, wherein said zinc brightener is an alpha-aminoaliphatic carboxylic acid.

55. A bath according to claim 16, wherein said zinc brightener is a salt of an alpha-aminoaliphatic carboxylic acid.

56. A bath according to claim 16, wherein said zinc brightener is an alpha-aminoaliphatic carboxylic acid and a salt of an alpha-aminoaliphatic carboxylic acid.

57. A bath according to claim 16, wherein said cation is hydrogen.

58. A bath according to claim 16, wherein said cation is sodium.

59. A bath according to claim 16, wherein said cation is potassium.

60. A bath according to claim 16, wherein said cation is zinc.

61. A bath according to claim 16, wherein said cation is calcium.

62. A bath according to claim 16, wherein said nonionic surface-active compound is a homopolymer of ethylene oxide.

63. A bath according to claim 16, wherein said nonionic surface-active compound is a propylene oxide-ethylene oxide block copolymer of a molecular weight of 500 or more, prepared by the sequential addition of propylene oxide and ethylene oxide in either order to a residue of any organic compound containing a plurality of active hydrogen atoms.

64. A bath according to claim 16, wherein said nonionic surface-active compound is the product obtained upon condensing from 6 to about 50 moles of ethylene oxide with a mole of naphthol.

65. A bath according to claim 16, wherein said nonionic surface-active compound is the product obtained upon condensing from 6 to about 50 moles of ethylene oxide with a mole of a long chain compound, said long chain compound selected from the group consisting of a long chain fatty acid, a long chain fatty alcohol, a long chain fatty amine, and a long chain alkyl phenol, wherein said long chain compound contains from about 6 to about 30 carbon atoms.

66. A bath according to claim 16, wherein said carbonyl compound is benzylidene acetone.

67. A bath according to claim 16, wherein said carbonyl compound is cinnamic aldehyde.

68. A bath according to claim 16, wherein said carbonyl compound is o-chlorobenzaldehyde.

69. A bath according to claim 16, wherein said carbonyl compound is 2,4-dichlorobenzaldehyde.

*70. A bath according to claim 16, wherein said carbonyl compound is 2,6-dichlorobenzaldehyde.*

*71. A bath according to claim 16, wherein said carbonyl compound is 2-hydroxyl-1-naphthaldehyde.*

*72. A bath according to claim 22, wherein said cation is hydrogen, wherein said carbonyl compound is o-chlorobenzaldehyde, and wherein said nonionic surface-active compound is the product obtained upon condensing from 6 to about 50 moles of ethylene oxide with a mole of a naphthol.*

*73. A bath according to claim 22, wherein said cation is hydrogen, wherein said carbonyl compound is o-chlorobenzaldehyde, and wherein said nonionic surface-active compound is the product obtained upon condensing from 6 to about 50 moles of ethylene oxide with a mole of a long chain compound selected from the group consisting of a long chain fatty acid, a long chain fatty alcohol, a long chain fatty amine, and a long chain alkyl phenol, said long chain compound having from about 6 to about 30 carbon atoms.*

* * * * *